US007111366B2

(12) United States Patent
Pinto

(10) Patent No.: US 7,111,366 B2
(45) Date of Patent: Sep. 26, 2006

(54) MACHINE FOR MAKING A NON-WOVEN FIBROUS WEB

(75) Inventor: Akiva Pinto, 1437 Franklin Blvd., PMB 117, Gastonia, NC (US) 28054

(73) Assignee: Akiva Pinto, Short Hills, NJ (US)

( * ) Notice: Subject to any disclaimer, the term of this patent is extended or adjusted under 35 U.S.C. 154(b) by 0 days.

(21) Appl. No.: 10/911,526

(22) Filed: Aug. 5, 2004

(65) Prior Publication Data

US 2006/0026801 A1 Feb. 9, 2006

(51) Int. Cl.
*D01G 15/00* (2006.01)
*D01G 21/00* (2006.01)

(52) U.S. Cl. ..... 19/98; 19/65 A

(58) Field of Classification Search ..... 19/65 A, 19/65 R, 98, 99, 100, 101, 105, 106 R, 108, 19/109, 112, 161.1, 200, 202, 203, 204, 205, 19/296, 299, 300, 304, 308; 28/117
See application file for complete search history.

(56) References Cited

U.S. PATENT DOCUMENTS 4,128,917 A * 12/1978 Varga ..... 19/105
4,523,350 A * 6/1985 Schmiedgen et al. ..... 19/98
4,797,978 A * 1/1989 Giuliani ..... 19/98
4,958,404 A * 9/1990 Lasenga ..... 19/98
5,095,584 A 3/1992 Temburg
5,201,103 A * 4/1993 Frosch et al. ..... 28/117
5,226,214 A 7/1993 Napolitano
5,584,101 A * 12/1996 Brabant et al. ..... 19/304
6,195,845 B1 * 3/2001 DuPont et al. ..... 19/300
6,568,037 B1 5/2003 Leder et al.
6,732,412 B1 * 5/2004 Collotte et al. ..... 19/308

* cited by examiner

*Primary Examiner*—Gary L. Welch

(57) ABSTRACT

The present invention provides a novel carding machine for preparing a continuous non-woven fibrous web. This machine is comprised of a succession of carding cylinders including a first carding cylinder and subsequently a final carding cylinder; said cylinders are in communication with one or more carding rolls—doffers and/or randomizing rolls arranged in juxtaposition and rotate wherein their axes horizontal; at least one feeding inlet unit in communication with said first carding cylinder; and at least one product outlet in communication with said last carding cylinder, wherein one or more product outlets commenced form said carding succession, previous to said final carding cylinder, The present invention also provides for a cost effective method for maintaining fiber density on the carding cylinder while increasing production rate of the machine through the discharge of a certain amount of fully opened fibers from the cylinder.

7 Claims, 4 Drawing Sheets

MACHINE FOR MAKING A NON-WOVEN FIBROUS WEB

FIELD OF THE INVENTION

The present invention generally relates to a carding machine for preparing a continuous non-woven fibrous web, and especially to such a machine comprising a plurality of product outlets commenced along the process succession previous to the final carding cylinder.

BACKGROUND OF THE INVENTION

Industrial carding machinery produce non-woven web forms mixtures of fibers such as polypropylene, polyethylene, cotton, viscose or regenerated fiber. A typical carding machine is having one or more main carding cylinders, and various other rolls that are arranged in juxtaposition and rotate wherein their axes horizontal. Fibers are traditionally fed and transferred to the first carding cylinder and carded by means of a plurality of sets of worker and striper rolls, which provide for a web of opened fibers of mainly longitudinal orientation. The carding succession continues wherein the fibers are processed by means of randomizing cylinders and doffer rolls that process the web until has a network characterization. Along the second or more carding cylinders along carding succession, the web is further processed to a predetermined measure. The finished carded web is then transferred to a set of complement rolls or air suction to a product conveyer belt.

It is known in the art that short fibers are discharge to waste by various suction chambers located adjacent to the main cylinder rolls and/or the doffer or other cylinders along the carding process. Hence, U.S. Pat. No. 6,568,037 to Leder and U.S. Pat. No. 5,095,584 to Temburg disclose few apparatuses for separating waste and short fibers from the carding process. Moreover, few inventions, such as U.S. Pat. No. 5,226,214 to Napolitano have presented a carding process characterized by a multiple doffing outlets, usually in a parallel configuration, located at the very last step of the process, after the last main carding cylinder. This invention is also teaching two or more combing cylinder adapted to convey the half-finished web to the second cylinder.

It is well acknowledge in the art that the carded web being processed along the carding cylinder is comprised of half-finished fiber web and a relatively minor portion of fully opened carded fibers. Said finished fibers are being re-cycled in this costly carding process and hence severely decrease homogeny and process productivity. Hence, a carding machine adapted for maintaining low fiber density on the main finisher cylinder while increasing production rate of the machine through the discharge of a certain amount of fully opened (-carded,) fibers from the breaker or first cylinder and thus increase in productivity and reduce the carding cost is still a long felt need.

BRIEF DESCRIPTION OF THE INVENTION

Figure 1:
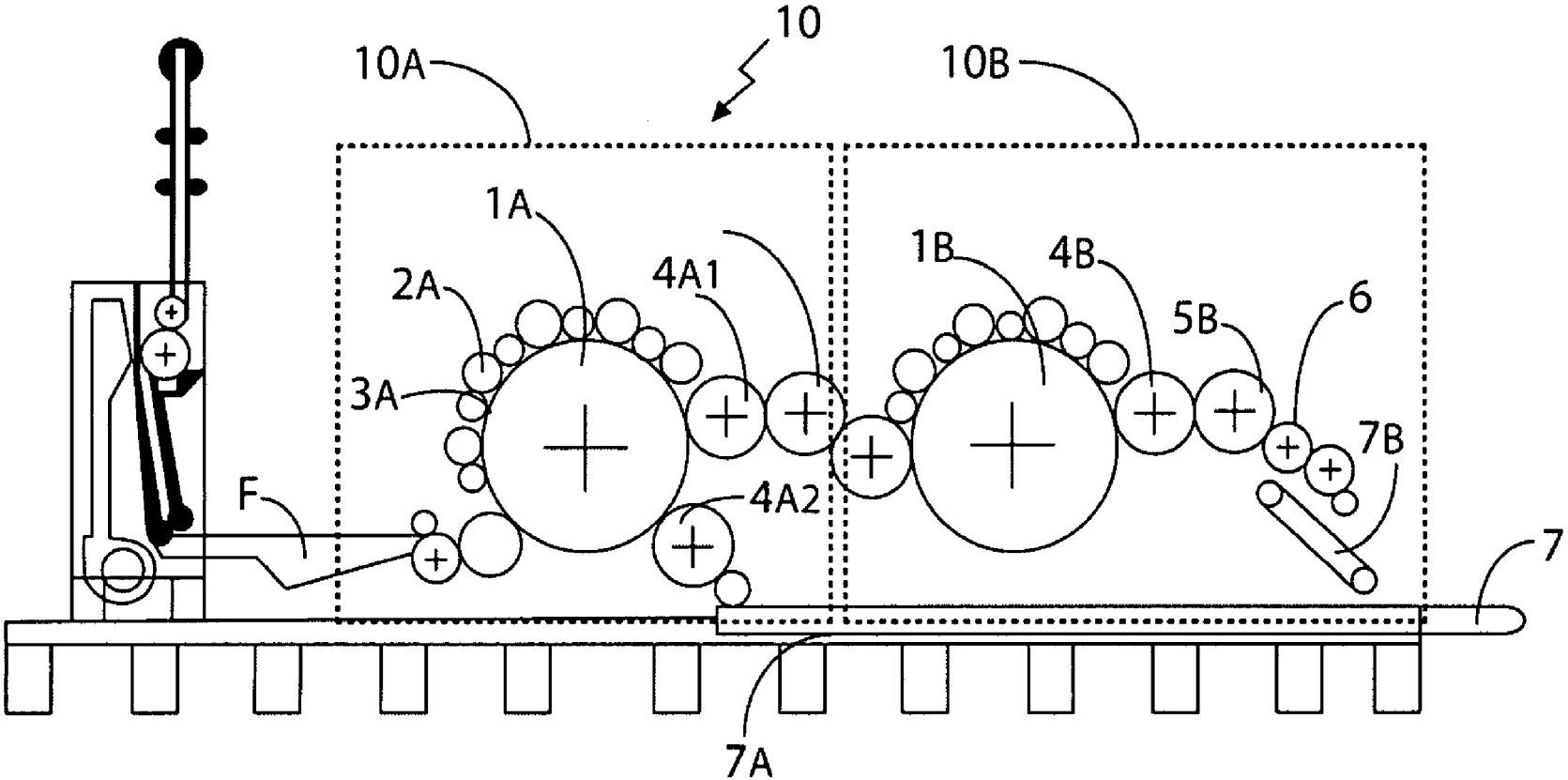

In order to understand the invention and to see how it may be implemented in Practice. plurality of embodiments will now be described, by way of non-limiting example only. with reference to the accompanying drawing, in which FIG. 1 schematically presents a carding machine (10) for preparing a continuous non-woven fibrous web according to one embodiment of the present invention. Wherein the second product outlet downstream from the first cylinder comprising one randomizing cylinder and or one doffer cylinder; said cylinders space first web forming group (10A) and a final web forming group (10B).

Figure 2:
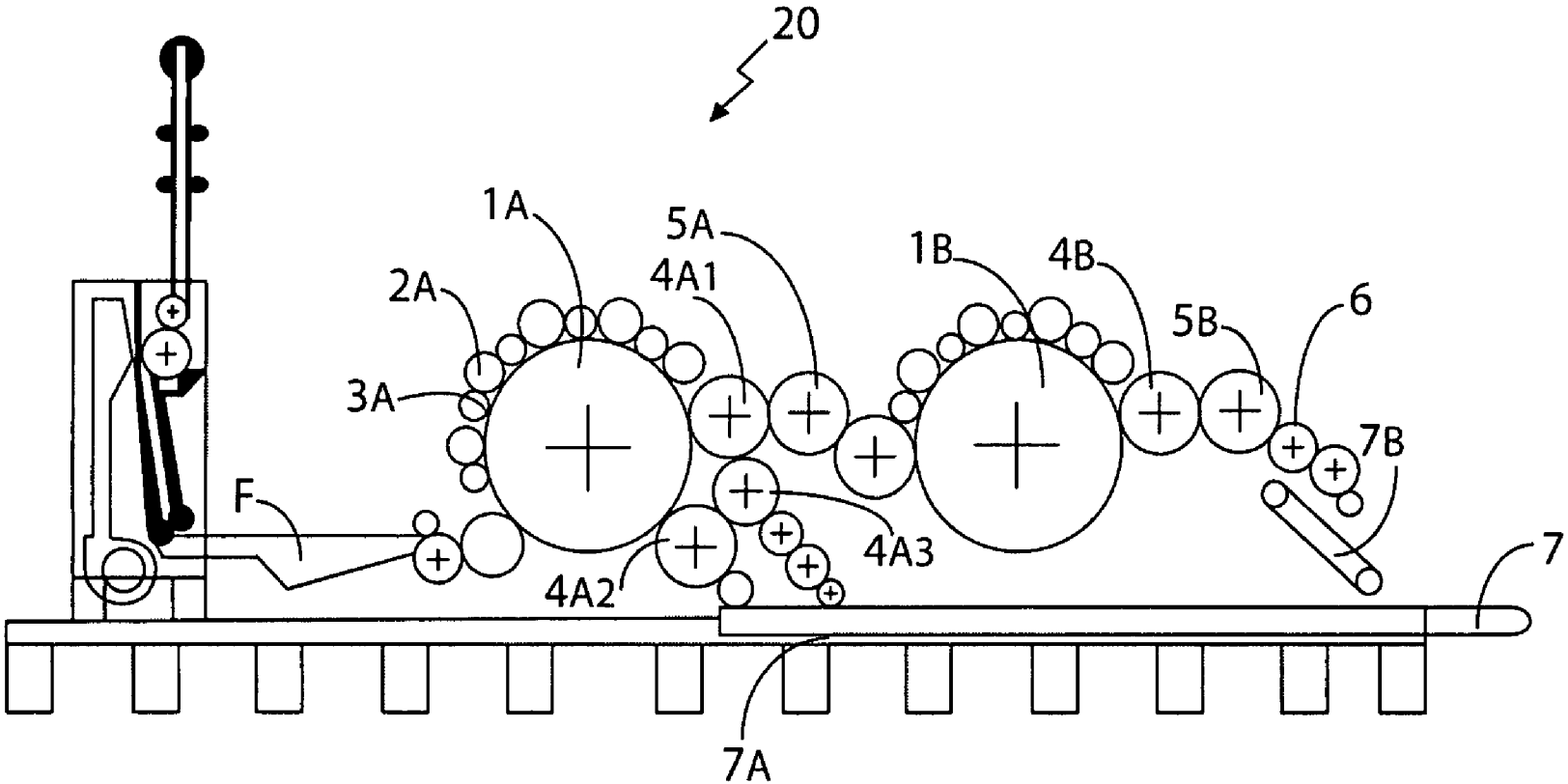
Figure 3:
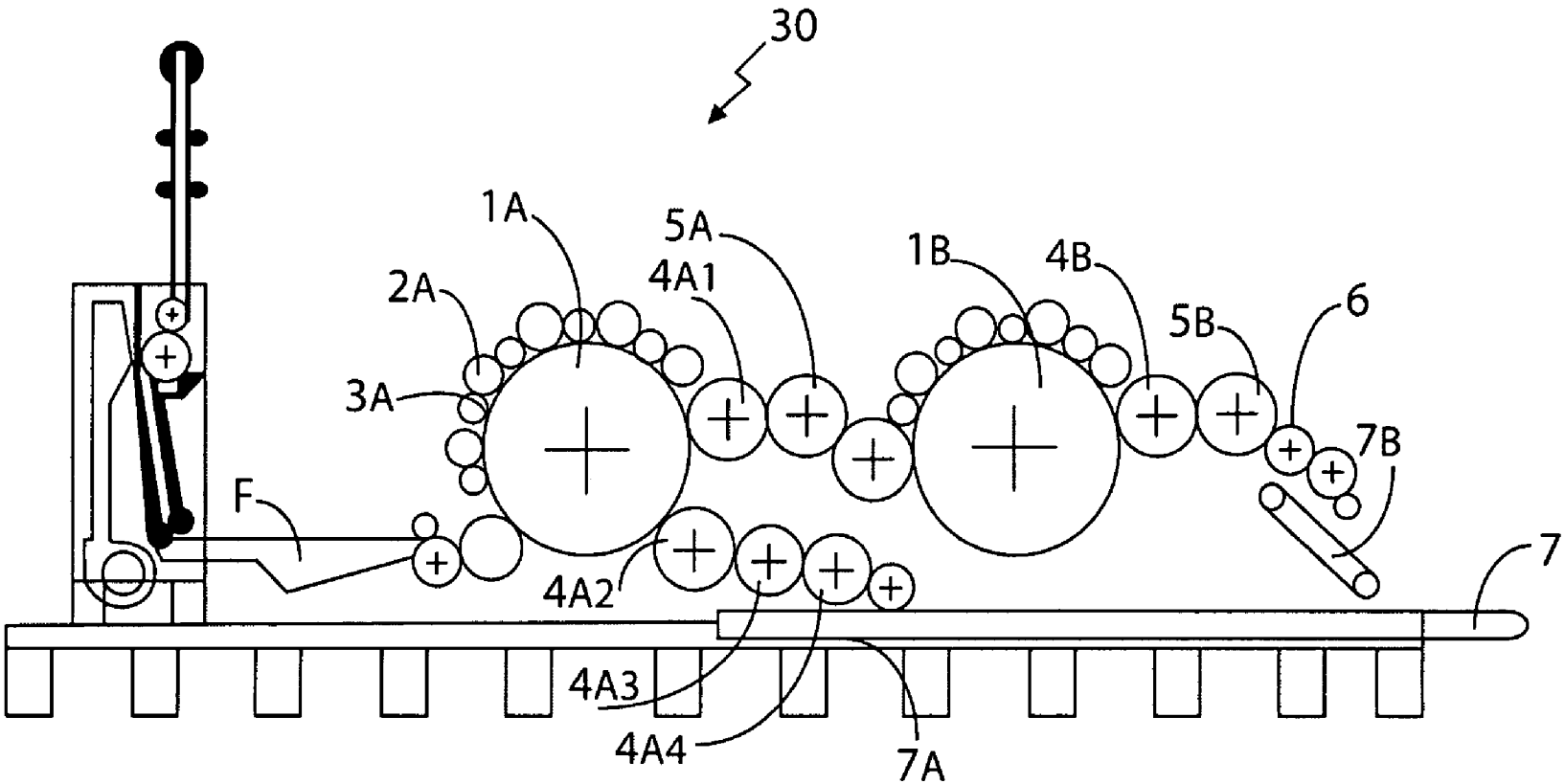
Figure 4:
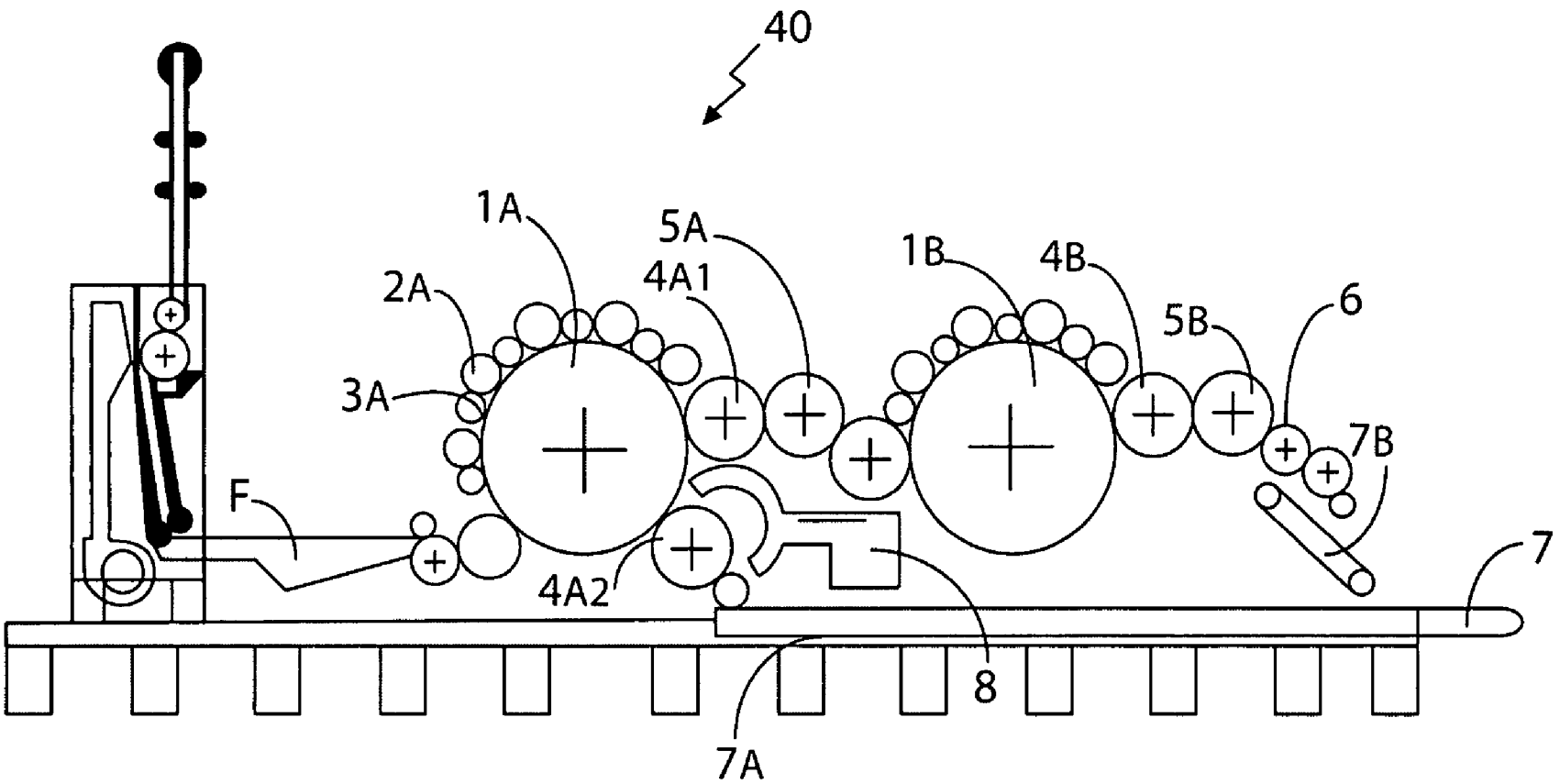

FIG. 2 schematically presents a carding machine according to another embodiment of the present invention (20} wherein the second product outlet downstream from the first cylinder comprising two randomizing cylinders and one doffer cylinder: the toe randomizing cylinder also transfer the main fiber quantity to the main carding cylinder:

FIG. 3 schematically presents a carding machine according to another embodiment of the present invention (30) wherein the second product outlet downstream from the first cylinder comprising one randomizing cylinders, one doffer cylinder and condensing rolls;

FIG. 4 schematically presents a carding machine according to another embodiment of the present invention (40), wherein the second product output downstream from the first Cylinder comprising one randomizing cylinder or one doffer cylinder in communication with a suitable suction or air lay means (S)).

SUMMARY OF THE INVENTION

It is one object of the present invention to present a useful carding machine for preparing a continuous non-woven fibrous web. This novel machine is comprised of:

(i) a succession of carding cylinders including a first carding cylinder and subsequently a final carding cylinder; said cylinders are in communication with one or more carding-rolls; doffers and/or randomizing rolls arranged in juxtaposition and rotate wherein their axes horizontal;

(ii) at least one feeding inlet unit in communication with said first carding cylinder; and (iii) at least one product outlet in communication with said last carding cylinder; wherein one or more product outlets commenced form said carding succession, previous to said final carding cylinder.

It is a further object of the present invention to present a cost effective method for maintaining fiber density on the carding cylinder while increasing production rate of the machine through the discharge of a certain amount of fully opened fibers from the cylinder previous to the final main cylinder. This method is essentially comprised of the step of collecting a predetermined measure of said carded fibers by means of one or more product outlets located before said final carding cylinder.

DETAILED DESCRIPTION OF THE INVENTION

The following description is provided, alongside all chapters of the present invention, so as to enable any person skilled in the art to make use of said invention and sets forth the best modes contemplated by the inventor of carrying out this invention. Various modifications, however, will remain apparent to those skilled in the art since the generic principles of the present invention have been defined specifically to provide a novel carding machine adapted for preparing a continuous non-woven fibrous web or other fiber forms comprising a plurality of fiber product outlets commenced along the process succession previous to the last carding cylinder.

The present invention generally relates to a carding machine suitable for preparing a continuous non-woven fibrous web. This machine is comprised of a succession of carding cylinders including a first carding cylinder and subsequently a final carding cylinder; said cylinders are in communication with one or more carding type-rolls doffers and/or randomizing rolls arranged in juxtaposition and rotate wherein their axes horizontal; at least one feeding inlet unit in communication with said first carding cylinder; and at least one product outlet in communication with said last carding cylinder; wherein one or more such product outlets commenced form said succession, previous to said last main carding cylinder.

More specifically, the present invention relates to a carding machine wherein the at least one of the product outlet is commenced from at least, one doffer cylinder juxtaposed to the any pre-carding cylinder and ahead of the main cylinder. Additionally or alternatively, the at least one of the product outlet is commenced form at least one randomizing cylinder juxtaposed to the first carding cylinder. Additionally or alternatively, the at least one of the product outlet is a succession commenced with at least one randomizing cylinder juxtaposed to the first carding cylinder, and continuous with at least one doffer.

Reference is made now to FIG. 1, presenting a carding machine (10) according to one embodiment of the present invention. The process succession is having a first (e.g., pre-) carding cylinder (1A) and subsequently a second and last carding cylinder (1B) said cylinders space said aroupsl (10A, 10B) apart. The machine is having one feeding inlet (F), e.g., in communication with said first web-forming group (10A), which is rotate clockwise and two downstream pathways. Along the first downstream process, the fibers are carded by means of a plurality of worker rolls (e.g., 2A) and striper rolls (e.g., 3A), and then continue the carding succession to a randomizing cylinder (4A1), doffer cylinder (5A) etc., to the second carding cylinder (1B). Here again the processed until a predetermined measure. Then, the carding succession is terminated by transfering the carded fibers to only one of a randomizing roll (4B), doffer roll (5A) and a plurality of complement condensing rolls (6B) to product intermediate conveyer belt (7B) and lastly to a final conveyer belt (7). Along the second downstream process (Sec 10B), which is the core of the present invention, the fibers are carded by means of the aforementioned plurality of worker rolls (e.g., 2A) and striper rolls (e.g., 3A), and then continue to second randomizing/doffer roll (4A2), and via a plurality of complement rolls, a predetermined measure of the processed fibers are exit the process to a forward extension (7A) of the product conveyer belt (7).

It is acknowledged in this respect that said second downstream carding may comprise (a) at least one of the following sequences: (a) a main carding cylinder, one or more doffer rolls, a plurality of complement rolls and a conveyer belt; (b) a main carding cylinder, one or more randomizing rolls, a plurality of complement rolls and a conveyer belt; (c) a main carding cylinder, two or more randomizing rolls, a doffer roll in communication with said two or more randomizing rolls, a plurality of complement rolls and a conveyer belt; (d) a main carding cylinder, at least one randomizing roll, two or more doffer cylinders in communication with said randomizing cylinder, a plurality of complement rolls and a conveyer belt or any combination thereof.

It is further acknowledged in this respect that the aforementioned carding systems are comprised according to another set of embodiments of the present invention effective means for assisting with air doffers and perforated suction belts.

Reference is hence made now to FIG. 2, presenting a carding machine (20) according to yet another embodiment of the present invention. The process succession is having a first carding cylinder (IA) and subsequently a second and last carding cylinder (IB), The machine is having one feeding inlet (F) in communication with said first carding cylinder (IA), which is rotate clockwise and two downstream pathways. The first downstream process is similar to the one presented in FIG. 1, and comprises cylinders 4A1, 5A, IB, 4B, 5B, 6 in the manner product is obtained in conveyor belt 7B. Along the second downstream process, the fibers are carded by means of the aforementioned plurality of worker rolls (e.g., 2A) and striper rolls (e.g., 3A), and then continue to second randomizing roll (4A2). Then, processed fibers in a predetermined measured are collected form first randomizing roll (4A1) and said second randomizing roll (4A2) by a means of one doffer roll (4A3), and via a plurality of complement rolls, a predetermined measure of the processed fibers are exit the process to a forward extension (7A) of the product conveyer belt (7).

Reference is made now to FIG. 3, presenting a carding machine (30) according to yet another embodiment of the present invention. The process succession is having a first carding cylinder (IA) and subsequently a second and last carding cylinder (IB), The machine is having one feeding inlet (F) in communication with said first carding cylinder (1A), The first downstream process is similar to the one presented in FIGS. 1 and 2, and comprises cylinders 4A1, 5A, IB, 4B, 5B, 6 in the manner product is obtained in conveyor belt 7B. Along the second downstream process, the fibers are carded by means of the aforementioned plurality of worker rolls (e.g., 2A) and striper roils (e.g., 3A), and then continue to second randomizing roll (4A2) and follows to a sequence of doffer rolls (4A3, 4A4), and via a plurality of complement rolls, a predetermined measure of the processed fibers are exit the process to a forward extension (7A) of the product conveyer belt (7), Reference is made now to FIG. 4) presenting a carding machine (40) according to yet another embodiment of the present invention. The process succession is having a first carding cylinder (IA) and subsequently a second and last carding cylinder (IB). The machine is having one feeding inlet (F) in communication with said first carding cylinder (IA). The first downstream process is similar to the one presented in FIGS. 1–3, and comprises rolls 4A1, 5A, 1B, 4B, 5B, 6 in the manner product is obtained in conveyor belt 7B. Along the second downstream process, the fibers are carded by means of the aforementioned plurality of worker rolls (e.g., 2A) and striper rolls (e.g., 3A), and then continue to second randomizing roll (4A2), At least a portion of the obtained product is collected by the commercially available means of suction, vacuum and/or enforced airflow (8), which is adapted to continuously collect the gathered product and direct it out of the process to a forward extension (7A) of the product conveyer belt (7).

The invention claimed is:

1. A machine for making a non-woven fibrous web, comprising:

a. a succession of two or more web-forming groups; each of said groups comprising:
   i. a carding cylinder (1A), in connection with at least two sets of workers (2A) and strippers (3A);
   ii. at least two cylinders being in conjunction with said carding cylinder, said cylinders space said groups apart, and are selected from randomizing cylinder (4A1), randomizing/doffer roll (4A2), cylinder (5A), doffer rolls (4A3) (4A4);

b. at least one feeding inlet unit in communication with said first web-forming group; and, c. at least one product outlet in communication with said final web-forming group where fully opened fibers are doffed and a finished web is formed;

wherein a portion of said half-finished fibers and relatively minor portion of said fully opened carded fibers are doffed prior to said final web-forming group; and further wherein said half-finished fibers are collected from any of said groups prior to said final group.

2. The machine according to claim 1, wherein the at least one product outlet is commenced from any of said groups prior to said final group by a means of at least one randomizing roll juxtaposed to the first carding cylinder.

3. The machine according to claim 1, wherein the at least one product outlet is a succession commenced from any of said groups prior to said final group by a means at least one randomizing roll juxtaposed to a carding cylinder, and continuous with at least one doffer.

4. The machine according to claim 1; wherein at least one product outlet being commenced from any of said groups prior to said final group; said outlet comprising means for suction, vacuum and/or enforced air flow, adapted to continuously collect the gathered product and/or doff by air the random roll.

5. The machine according to claim 1, wherein the at least one product outlet is commenced from any of said groups prior to said final group by a means of at least one doffer cylinder juxtaposed to a carding cylinder.

6. The machine according to claim 1, wherein at least one product outlet being commenced previous to the last carding cylinder from any of said groups prior to said final group is followed by a conveyer belt adapted to continuously collect the gathered product.

7. A method for maintaining fiber density on the carding cylinder while increasing production rate of the machine through the discharge of a certain amount of fully-opened fibers from the cylinder comprising:

a. obtaining a machine for making a non-woven fibrous web comprising a succession of two or more web-forming groups; each of said groups comprising i. a carding cylinder (1A), in connection with at least two sets of Workers (2A) and Strippers (3A);

ii. at least two cylinders being in conjunction with said carding cylinder, said cylinders space said groups apart, and are selected from randomizing cylinder (4A1), randomizing/doffer roll (4A2), cylinder (5A), doffer rolls (4A3) (4A4);

b. obtaining at least one feeding inlet unit in communication with any of said groups prior to said final group;

c. obtaining at least one product outlet in communication with said final web-forming group where fully opened fibers are doffed and a finished web is formed;

d. doffing a portion of said half-finished fibers and relatively minor portion of said fully opened carded fibers prior to said final web-forming group; and, e. collecting said half-finished fibers from any of said group prior to said final group.

* * * * *